US005356072A

United States Patent [19]

Thomas

[11] Patent Number: 5,356,072

[45] Date of Patent: Oct. 18, 1994

[54] MAILBOX MOUNTING DEVICE TO ABSORB LATERAL IMPACT

[76] Inventor: Frank P. Thomas, 108 Snowden St., Sumter, S.C. 29150

[21] Appl. No.: 985,003

[22] Filed: Dec. 2, 1992

[51] Int. Cl.[5] ..... B65D 91/00

[52] U.S. Cl. ..... 232/39; 232/17

[58] Field of Search ..... 232/17, 39, 38; 411/366, 395; 40/608; 248/218.4; 188/380; 267/164, 174; 403/291

[56] References Cited

U.S. PATENT DOCUMENTS

| | | | |
|---|---|---|---|
| 1,273,696 | 7/1918 | Vanhoof | 248/145 |
| 2,433,263 | 12/1947 | Conrad et al. | 248/145 |
| 2,550,338 | 4/1951 | Dunagan | 248/145 |
| 2,738,941 | 3/1956 | Laurich et al. | 248/145 |
| 2,936,143 | 5/1960 | Anderson | 248/145 |
| 3,407,997 | 10/1968 | Wood et al. | 248/145 X |
| 3,758,058 | 9/1973 | Neudeck | 411/366 |
| 3,999,702 | 12/1976 | Conroy | 232/39 |
| 4,172,579 | 10/1979 | Steinman | 232/39 |
| 4,187,987 | 2/1980 | Dowker | 248/145 X |
| 4,368,842 | 1/1983 | Delange, III | D99/29 X |
| 4,792,088 | 12/1988 | Bonnell | 248/156 X |
| 4,821,952 | 4/1989 | Deciutiis | 232/39 |
| 5,029,783 | 7/1991 | Alvarez | 248/146 |
| 5,060,900 | 10/1991 | Kokoruda | 232/39 |
| 5,119,986 | 6/1992 | Kobilarcik | 232/17 |
| 5,215,283 | 6/1993 | Gould | 232/39 |

FOREIGN PATENT DOCUMENTS

| | | | |
|---|---|---|---|
| 78161 | 2/1894 | Austria | 267/174 |

*Primary Examiner*—Flemming Saether
*Attorney, Agent, or Firm*—Michael A. Mann

[57] ABSTRACT

A shock-absorbing mailbox mounting assembly. The device includes an anchor with a head and a hollow shank, a locking nut, a nail, and a coiled spring. The mailbox is centered on a support beam with its opposing side flanges spaced apart from each side of the beam. The anchor is inserted through one of the side flanges and the locking nut is secured to the anchor, holding the anchor in fixed position against the flange. The spring is placed around the shank of the anchor, between the locking nut and the beam. The nail is driven through the anchor into the beam. The mailbox is attached to the beam by a plurality of such devices, preferably two on each side. When struck, the mailbox slides laterally on the nails but is returned to its nominal position by the restoring action of the springs.

8 Claims, 2 Drawing Sheets

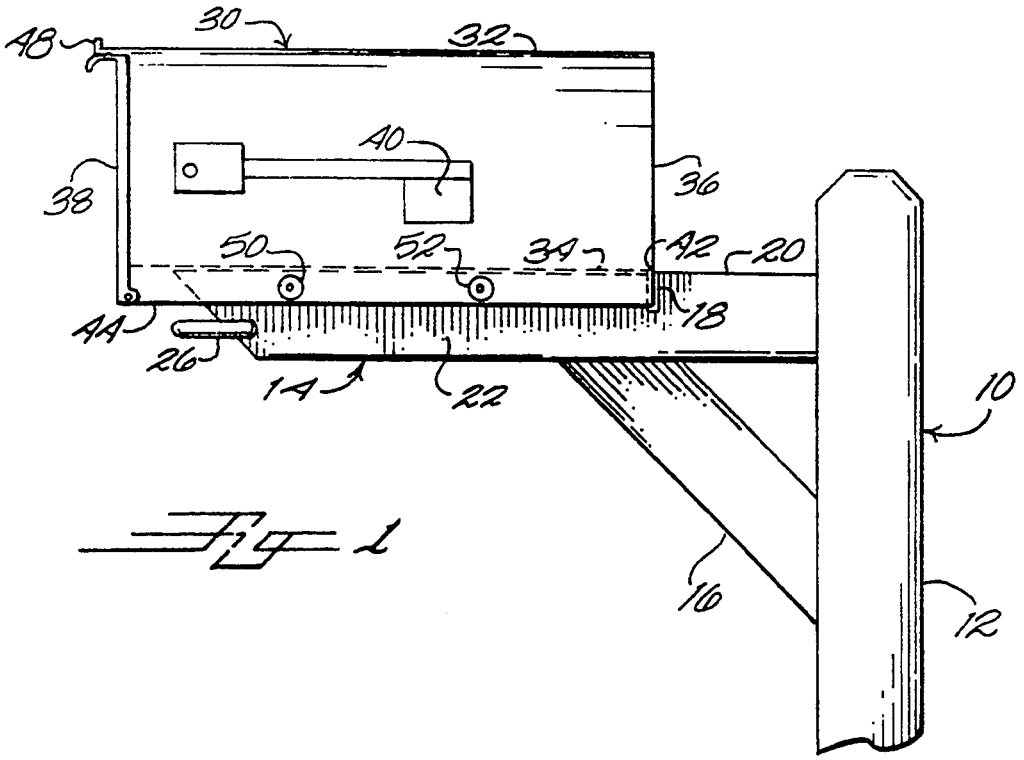
Fig 1
Fig 3
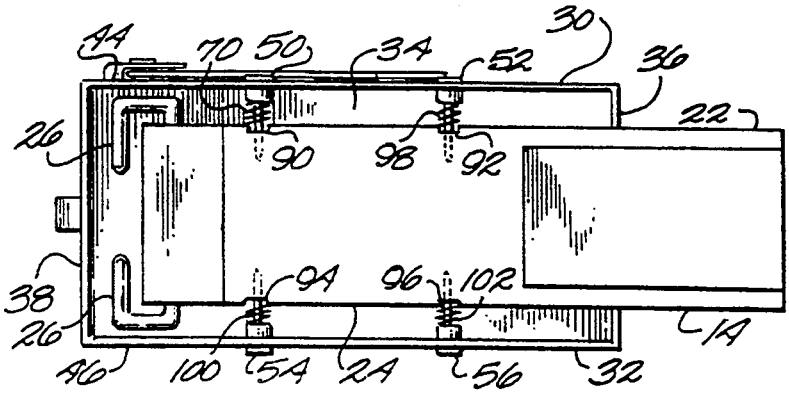

MAILBOX MOUNTING DEVICE TO ABSORB LATERAL IMPACT

BACKGROUND OF THE INVENTION

1. Field of the Invention

The present invention relates to mailbox mounts. More particularly, the present invention relates to a mailbox mount that is able to withstand lateral stress from vandalism or accident.

2. Discussion of Background

The familiar rural mailbox is typically attached to an inverted L-shaped stand comprising a vertical post or standard and a horizontal beam. These stands may bend or break when struck by an automobile or other moving object, necessitating repair or replacement.

Mailboxes themselves are also frequently damaged by collisions with moving vehicles or other objects, or by vandalism. Vandals use baseball bats and the like to strike a mailbox, denting or crushing the box or dislodging it from the stand. Most rural mailboxes are made of thin-gauge metal no more than about ⅛" (about 0.32 cm) thick, or plastics such as polypropylene. Metal mailboxes are especially susceptible to abuse since they are easier to dent. Polypropylene mailboxes are more dent-resistant than metal mailboxes, but may be dislodged from a stand when struck with sufficient force.

Several U.S. patents address these problems. For example, Alvarez (U.S. Pat. No. 5,029,783) and Bonnell (U.S. Pat. No. 4,792,088) incorporate coil springs in the vertical support post. The post yields to the mechanical force exerted by a moving object such as an automobile and rebounds to its original erect position once the force is removed. Devices are available to support the mailbox in such a way that it can be moved without damage to it or its support, including rotatable mailbox mounts (Vanhoof, U.S. Pat. No. 1,273,696; Wood, U.S. Pat. No. 3,407,997; Anderson, U.S. Pat. No. 2,936,143; Laurich, et at., U.S. Pat. No. 2,738,941) and standards with swinging arms for supporting a mailbox for easy accessibility (Dunagan, U.S. Pat. No. 2,550,338; Conrad, et al., U.S. Pat. No. 2,433,263).

Reinforcing devices or shields are available for protecting a mailbox from impact. For example, Dowker (U.S. Pat. No. 4,187,978) provides a flexible cage surrounding at least a portion of a mailbox. The cage is adapted to absorb or damp at least a portion of the impact of any collision. DeLange, III (U.S. Pat. No. 4,368,842) encloses the mailbox in a cage constructed of impact-resistant material.

The effectiveness of these devices is limited. If the mailbox itself is rigidly attached to its stand, it can be dislodged or damaged when struck despite a flexible post or protective cage. There is a need for means for securely, but flexibly attaching a mailbox to a stand in such a way that the mailbox can absorb shocks due to collision or vandalism.

SUMMARY OF THE INVENTION

According to its major aspects and broadly stated, the present invention is a shock-absorbing mailbox mount. The mount includes a plurality of assemblies for attaching a standard polypropylene mailbox directly to a support beam, rather than to a board attached to the top of the beam. Each assembly comprises an anchor pin with a head and a hollow shank, a locking nut, a nail, and a coiled spring, which, when assembled, holds the mailbox to the beam but allows it to move laterally.

The standard mailbox has a "skirt" or flange depending from its sides. If the box is placed on the support beam, this flange hangs past the sides of the beam except for the rear of the box. A transverse notch or slot is cut in the support beam near the end of the beam for this part of the flange. The base of the box thus can rest directly on the beam with flange running along the sides of the support beam.

The anchors are inserted through the flange into the support beam and secured by the locking nuts on the insides of the flange. The springs are then placed around the shank of the anchor between the locking nut and the beam. The nails are driven through the anchor, lock nut, and spring into the beam. Once these assemblies are secured, the anchors can slide laterally with respect to the nails but constrained by the force of the spring. Thus mounted, the assembly includes two sections in addition to the spring: a first section including the nail, and a second section including the anchor and locking nut. The first section, attached to the beam, slidably carries the second section, attached to the mailbox.

Preferably, the mailbox is secured by at least one assembly to each side and most preferably two spaced-apart assemblies on each side. The nominal position of the mailbox is centered on the beam. When the mailbox is struck on the side, the mounting devices absorb the impact thereby reducing damage to the mailbox. The mailbox is urged to its nominal position by the restoring action of the springs. A polypropylene or similar plastic mailbox is preferred to metal because polypropylene withstands moderate impacts without denting.

An important feature of the present invention is the spring, which maintains the relative alignment of the mailbox and the beam. When the mailbox is struck by a moving object, the mailbox is displaced, and the springs of the assemblies compress as the mailbox is forced laterally on the nails. The decompression of the springs urges a return of the mailbox to its preferred position. The springs therefore absorb the energy of impact.

Another feature of the present invention is the nail. The nail is attached to the beam and acts as a track for lateral movement of the anchor. Movement of the mailbox is constrained to lateral displacement along the nails of the mounting devices that attach the mailbox to the beam. The nail thus serves two functions, holding the mailbox to the beam and guiding the box when it suffers lateral impact.

An additional feature of the present invention is the combination of the polypropylene mail box and the mounting system. The box resists denting and the mounting system absorbs shock. Between the two, the box can withstand most vandalism and many accidents essentially undamaged.

Finally, a feature of the invention is the fact that the mailbox is attached through the sides of the flange to the beam rather than to a board on the beam. By eliminating the board, the possibility of a vandal hitting the board from below and thereby knocking it off the beam is eliminated. Furthermore, the present mailbox does not extend beyond the sides of the beam far enough for a vandal to hit the mailbox effectively from below.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 1 is a side view of a mailbox attached to a stand using a shock absorbing mounting device according to the present invention;

FIG. 3 is a view along the lines 3—3 of FIG. 1;

DETAILED DESCRIPTION OF A PREFERRED EMBODIMENT

Figure 4:
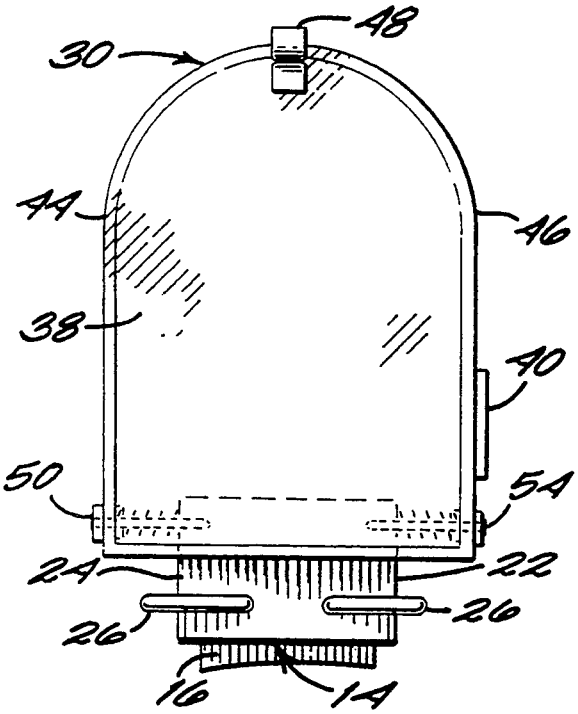
FIG. 4 is a front view of the mailbox of FIG. 1.

Referring now to FIGS. 1, 3 and 4, there is shown a mailbox attached to a supporting beam by a device according to a preferred embodiment of the present invention. A stand 10 has a vertical post or standard 12, a generally horizontal beam 14, and a brace 16. Post 12, beam 14 and brace 16 are usually made of treated 4×4 lumber. Horizontal beam 14 has a transverse notch 18 in upper surface 20. Beam 14 has opposing side surfaces 22, 24. Post 12 is secured in a concrete slab or inserted into the soil adjacent to a road, or otherwise fixed in a position where it is readily accessible to the rural mail carrier. A pair of bolts 26 are driven in beam 14 to protect the underside of a mailbox 30.

Mailbox 30 has a housing 32, a floor 34, a rear wall 36, a door 38, and a flag 40. Housing 32 may be curved as shown, or assume a rectangular or some other desired form. Rear wall 36 terminates in a rear flange 42. If present, flange 42 is received in notch 18 of beam 14 when mailbox 30 is positioned on beam 14. The sides of housing 32 terminate in opposing base flanges 44 and 46. Floor 34 is adjacent to upper surface 20 of horizontal beam 14; flanges 44 and 46 are spaced apart from sides 22, 24 of beam 14.

Door 38 typically faces the road, and is hingedly attached to mailbox 30 so that mail may be placed into and removed from the mailbox. Flag 40 is rotatable from its rest position to an upright position (not shown) to signal the presence of mail for pick-up by the carrier. A latch 48 secures door 38 in its closed position. Mailbox 30 is attached to beam 14 by a plurality of anchor mounting assemblies 50, 52, 54, 56 in a manner to be described below.

Figure 2:
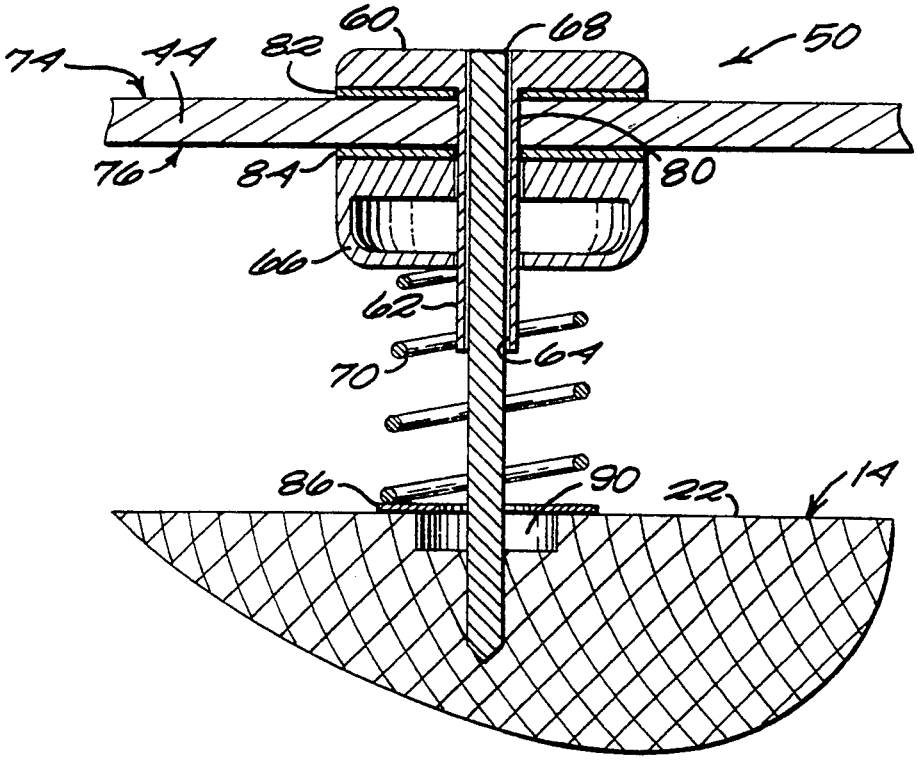
FIG. 2 is a cross-sectional view of a shock-absorbing mounting device according to the present invention.

A cross-sectional view of a shock-absorbing mounting assembly according to a preferred embodiment of the present invention is shown in FIG. 2. Anchor mounting assembly 50 includes a head 60, a shank 62 and a bore 64, a locking nut 66, a rod or nail 68, and a coiled spring 70.

Anchor assembly 50 secures side flange 44 of mailbox 30 to horizontal beam 14 of stand 10. Mailbox 30 is placed on beam 14 with rear flange 42 in notch 18 and floor 34 adjacent to upper surface 20. A hole 80, in flange 44, is aligned with a notch 90 of beam 14. Plank 62 is inserted through hole 80 so that head 60 is at or near an outer surface 74 of flange 44. Nut 66 abuts an inner surface 76 of flange 44, locking shank 62 into the position shown in FIG. 2. Spring 70 is placed over shank 62, between locking nut 66 and beam 14.

If desired, a washer 82 may be interposed between flange 44 and head 60 of anchor mounting assembly 50, a washer 84 between flange 44 and locking nut 66, and a washer 86 between beam 14 and spring 70. Nail 68 is driven through bore 64 into notch 90 and beam 14. Assembly 50 therefore includes two sections in addition to spring 70: first section including nail 68 attached to beam 14, and a second section including anchor assembly 50 attached to mailbox 30. This first section slidably carries second section.

If desired, spring 70 may be provided with a cover (not shown) of rubber or some other flexible material, to protect spring 70 and other components of anchor assembly 50 from dust, dirt, and moisture. A lag screw (not shown) may secure mailbox 30 to the front of beam 14.

After nail 68 is in place, its head may be cut off flush with head 60 of anchor assembly 50 or left as shown in FIG. 2 to serve as a stop for limiting the range of motion of nail 68 with respect to anchor assembly 50. If desired, nail 68 may be the type of nail that has a decorative head, which may be left in place for its esthetic effect. Nail 68 may be any convenient type of nail, such as a wood nail or screw-shanked nail. Alternatively, nail 68 may have a threaded shank that is screwed into beam 14.

Mailbox 30 is attached to beam 14 by a plurality of devices as described above, preferably at least one device on each side of mailbox 30 and most preferably four anchor mounting assemblies 50, 52, 54, 56 as shown in FIG. 3. A front view of mailbox 30 is shown in FIG. 4. Mailbox 30 and assemblies 50, 52, 54, 56 thus have a preferred position, centered on beam 14, where the forces exerted by the springs in anchor assemblies 50, 52, 54, and 56 are approximately equal. When struck by a moving object, mailbox 30, 98, 100, 102 moves generally as follows: springs 70, 94, 96, 98 of assemblies 50, 52, 54, 56, respectively, are each in operational contact with both the mailbox and the beam. Springs 70, 98, 100, 102 compress in response to the impact. Bore 64 of anchor assembly slides over nail 68, and the corresponding bores of assemblies 52, 54, 56 slide over their respective nails, the nails serving as tracks for the displacement of mailbox 30 from its nominal or preferred position. Compressed springs 70, 98, 100, 102 rebound, returning mailbox 30 to the preferred position. Nail 68 slides within bore 64 of anchor 50, and the nails of assemblies 52, 54, 56 slide within their respective bores, driven by the decompression of the springs. The greater the impact, the greater the restoring force that urges mailbox 30 to return to its preferred position. As will be evident, the springs in mounting assemblies 50, 52, 54, and 56 normally maintain mailbox 30 and beam 14 in relative alignment, with the nails and anchors in their nominal positions. The springs may be pre-compressed sufficiently to exert an effective amount of force that maintains mailbox 30 and beam 14 in relative alignment.

In an alternative embodiment shown in FIG. 4, two bolts 26 are driven into beam 14 to protect mailbox 30 from damage as a result of being struck from underneath. The bolts are spaced somewhat closer together than the width of a baseball bat, approximately two to three inches, and bent so that they protect the underside of box 30.

The components of anchor assembly 50 are made of any suitable materials that are reasonably able to withstand the environment wherein mailbox 30 will be used. Thus, anchor assembly 50 may be a metal or alloy such as aluminum, brass, or stainless steel. For durability and corrosion-resistance, anchor assembly 50 is preferably stainless steel. Similarly, locking nut 66, nail 68, spring 70, and washers 82, 84, 86 (if present) are made of any convenient materials, preferably stainless steel. If desired, the materials may be chosen for their esthetic effect as well as their functional qualities. For example, head 60 of anchor assembly 50 may be embossed, laminated, colored, plated, or otherwise treated to present a pleasing appearance in combination with housing 32 of mailbox 30.

Anchor assembly 50 is appropriately dimensioned to mailbox 30. Thus, a standard size mailbox measures approximately 8" (about 20 cm) in cross-section and 2' (about 60 cm) long. For such a mailbox, anchor assembly 50 may be approximately 2"14 3" (about 5–8 cm) long and 174" (about 0.6 cm) in diameter, with the other components sized accordingly. Differently-sized components may be needed for larger or smaller mailboxes.

Mailbox post 10 is usually wood, preferably pressure-treated wood for resistance to moisture. However, a mounting assembly according to the present invention may be used with stands made of other materials. For example, if post 10 is made of metal tubing, nail 68 may be replaced by a rod having a threaded end screwed into horizontal beam 14. Notches 90, 92, 94, 96 are positioned on beam 14 at appropriate positions to aid in attaching mailbox 30 thereto. Notches 90, 92, 94, 96 may be omitted if desired.

Mailbox 30 is preferably made of polypropylene because polypropylene, unlike sheet metal, can withstand moderate impacts without significant denting. Use of anchor assembly 50 will, however, help prevent dislodging of a metal mailbox upon impact even if the mailbox is dented. The proper locations for inserting nails 68 may be precut or premarked on flanges 44 and 46. Nails 68 may be driven into precut holes, or, if flanges 44 and 46 are thin, simply driven through the flanges into beam 14.

Assembly 50 as described is rigidly secured to mailbox 30 by locking nut 66. Anchor assembly 50 (and mailbox 30) are slidable on nail 68, rigidly attached to horizontal beam 14. This arrangement can be varied without departing from the spirit of the present invention. Thus, beam 14 could be provided with a cavity, and a rod such as nail 68 could be rigidly attached to mailbox 30. Such a rod would be slidable within the cavity in beam 14, for an effect analogous to the action of anchor assembly 50.

A mailbox secured to a post by two or more shock-absorbing anchor mounting assemblies 50 according to the present invention is highly resistant to petty vandalism as well as collisions with moving vehicles and other mechanical shocks. The combination of a polypropylene mailbox and anchor mounting assemblies 50 allows the mailbox to resist denting; the mounting devices absorb shock. The mailbox is not dislodged upon impact, but slides laterally and returns to its nominal position centered on horizontal beam 14. In addition, mailbox 30 is attached to beam 14 through flanges 44, 46 rather than to a board on the beam. By eliminating the board, the possibility of a vandal hitting the board from below and thereby knocking the mailbox off the beam is eliminated. Furthermore, a mailbox mounted as described above does not extend far enough beyond the sides of the beam for a vandal to hit it effectively from below. Once mounted, the mailbox does not appear to be out of the ordinary; it does not have a distinctive appearance that might invite vandalism.

It will be apparent to those skilled in the art that many changes and substitutions can be made to the preferred embodiment herein described without departing from the spirit and scope of the present invention as defined by the appended claims.

What is claimed is:

1. A mailbox assembly for attachment to a beam, said beam having a top and sides, said assembly comprising;

a mailbox having a flange, said mailbox positioned on said beam so that said flange depends along said sides of said beam; and means for attaching said mailbox to said beam through said flange of said mailbox into said sides of said beam, said attaching means having a first section attached to said beam, a second section attached to said mailbox, said first section slidable with respect to said second section, and spring means positioned between the flange and the sides of the beam for restoring said mailbox to said nominal position when compressed by lateral displacement of said mailbox with respect to said beam.

2. The mailbox assembly as recited in claim 1, wherein said mailbox is made of plastic.

3. The mailbox assembly as recited in claim 1, wherein said beam has a front and said assembly further comprises two bolts driven into said front of said beam below said mailbox.

4. A mailbox assembly for attachment to a beam, said beam having a top and sides, said assembly comprising:

a mailbox having a flange, said mailbox positioned on said top of said beam so that said flange depends along the sides of said beam; and means for attaching said mailbox to said beam, said attaching means having a plurality of rods driven partially into said sides of said beam, a plurality of anchors slidably carried by said plurality of rods, each anchor of said plurality of anchors carried by one rod of said plurality of rods, a plurality of lock nuts securing said plurality of anchors to said mailbox, each lock nut of said plurality of lock nuts securing one anchor of said plurality of anchors, and a plurality of springs biasing said mailbox to a position when compressed by lateral displacement of said mailbox with respect to said beam, each spring of said plurality of springs engaging one lock nut of said plurality of lock nuts and said beam.

5. The mailbox assembly as recited in claim 1, wherein said mailbox is made of plastic.

6. The mailbox assembly as recited in claim 1, wherein said beam has a front and said assembly further comprises two bolts driven into said front of said beam below said mailbox.

7. A device for attaching a mailbox to a beam, said mailbox having a flange, said mailbox positioned on said beam so that said flange depends along said sides of said beam, said device comprising:

a plurality of rods driven partially into said sides of said beam;

a plurality of anchors slidably carried by said plurality of rods, each anchor of said plurality of anchors carried by one rod of said plurality of rods;

a plurality of lock nuts securing said plurality of anchors to said mailbox, each lock nut of said plurality of lock nuts securing each anchor of said plurality of anchors, said flange of said mailbox being between said each lock nut and said one anchor; and a plurality of springs biasing said mailbox to a nominal position when compressed by lateral displacement of said mailbox with respect to said beam, each spring of said plurality of springs engaging one lock nut of said plurality of lock nuts and said beam.

8. The mailbox assembly as recited in claim 1, wherein said beam has a front and said assembly further comprises two bolts driven into said front of said beam below said mailbox.

* * * * *